US009981789B2

(12) United States Patent
Koller et al.

(10) Patent No.: US 9,981,789 B2
(45) Date of Patent: May 29, 2018

(54) CONTAINER ASSEMBLY WITH ONE-PIECE CHILD RESISTANT CLOSURE

(71) Applicant: Drug Plastics & Glass Company, Inc., Boyertown, PA (US)

(72) Inventors: Nathaniel Koller, Boyertown, PA (US); Douglas S. Camomile, Boyertown, PA (US); Bruce T. Cleevely, Boyertown, PA (US); Lissa Biesecker Longacre, Boyertown, PA (US)

(73) Assignee: Drug Plastics & Glass Company, Inc., Boyertown, PA (US)

( * ) Notice: Subject to any disclaimer, the term of this patent is extended or adjusted under 35 U.S.C. 154(b) by 938 days.

(21) Appl. No.: 14/477,434

(22) Filed: Sep. 4, 2014

(65) Prior Publication Data

US 2015/0076103 A1 Mar. 19, 2015

Related U.S. Application Data

(60) Provisional application No. 61/877,637, filed on Sep. 13, 2013.

(51) Int. Cl.
*B65D 50/04* (2006.01)

(52) U.S. Cl.
CPC ..... *B65D 50/046* (2013.01)

(58) Field of Classification Search
CPC .. B65D 50/046; B65D 50/045; B65D 50/043; B65D 50/041; B65D 41/06; B65D 2215/02
USPC ..... 215/220, 216
See application file for complete search history.

(56) References Cited

U.S. PATENT DOCUMENTS

| | | | | |
|---|---|---|---|---|
| 3,698,584 | A * | 10/1972 | Miller | B65D 50/046 215/216 |
| 3,830,391 | A * | 8/1974 | Uhlig | B65D 50/046 215/216 |
| 5,197,602 | A | 3/1993 | Biesecker et al. | |
| D346,329 | S | 4/1994 | Biesecker, II | |
| 5,315,811 | A | 5/1994 | Biesecker et al. | |
| D356,038 | S | 3/1995 | Biesecker | |
| D387,672 | S | 12/1997 | Biesecker | |
| D391,485 | S | 3/1998 | Biesecker, II et al. | |
| D392,897 | S | 3/1998 | Biesecker et al. | |
| 6,243,936 | B1 | 6/2001 | Biesecker et al. | |

(Continued)

*Primary Examiner* — Anthony Stashick
*Assistant Examiner* — Blaine Neway
(74) *Attorney, Agent, or Firm* — Panitch Schwarze Belisario & Nadel LLP

(57) ABSTRACT

A container and child-resistant closure assembly includes a cap formed from a single piece, a cup shaped inner member having a top wall, an outer wall, and a depending sidewall. The sidewall includes a threaded interior surface. The outside wall of the inner member includes connection members for securing to an outer member. The outer member has a ring-shape with a plurality of inwardly facing lugs. Each of the plurality of inwardly facing lugs is cylindrically-shaped and protrudes radially inwardly from the outer member. The container assembly also includes a container including a neck forming an opening. The neck has a threaded exterior surface and a plurality of ramps. Each of the plurality of ramps faces radially outwardly from the neck and has a gently sloping face and a steeply sloping face.

19 Claims, 8 Drawing Sheets

(56) References Cited

U.S. PATENT DOCUMENTS

| | | | | |
|---|---|---|---|---|
| 6,446,823 | B2 * | 9/2002 | Miceli | B65D 41/06 215/222 |
| D473,466 | S | 4/2003 | Biesecker | |
| D481,640 | S | 11/2003 | Biesecker | |
| D495,599 | S | 9/2004 | Biesecker | |
| 6,854,613 | B2 | 2/2005 | Biesecker et al. | |
| D503,886 | S | 4/2005 | Biesecker | |
| D511,457 | S | 11/2005 | Biesecker et al. | |
| D512,912 | S | 12/2005 | Biesecker et al. | |
| D513,585 | S | 1/2006 | Biesecker et al. | |
| D546,181 | S | 7/2007 | Biesecker et al. | |
| D586,213 | S | 2/2009 | Wells et al. | |
| 7,527,159 | B2 * | 5/2009 | Brozell | B65D 41/0471 215/222 |
| D597,840 | S | 8/2009 | Biesecker et al. | |
| D603,265 | S | 11/2009 | Biesecker | |
| D611,344 | S | 3/2010 | Longacre | |
| D611,346 | S | 3/2010 | Camomile | |
| D618,099 | S | 6/2010 | Biesecker et al. | |
| D619,473 | S | 7/2010 | Biesecker et al. | |
| D622,591 | S | 8/2010 | Biesecker et al. | |
| D623,518 | S | 9/2010 | Camomile | |
| D630,518 | S | 1/2011 | Biesecker et al. | |
| D657,673 | S | 4/2012 | Biesecker | |
| D657,674 | S | 4/2012 | Biesecker | |
| D663,202 | S | 7/2012 | Biesecker et al. | |
| D666,495 | S | 9/2012 | Biesecker et al. | |
| D674,697 | S | 1/2013 | Biesecker et al. | |
| 8,590,719 | B2 | 11/2013 | Sprishen et al. | |
| 8,777,032 | B2 | 7/2014 | Biesecker et al. | |
| 2005/0109726 | A1 * | 5/2005 | Alley | B65D 50/063 215/329 |

* cited by examiner

CONTAINER ASSEMBLY WITH ONE-PIECE CHILD RESISTANT CLOSURE

CROSS-REFERENCE TO RELATED APPLICATIONS

The present application claims the benefit of U.S. Provisional Patent Application No. 61/877,637, filed on Sep. 13, 2013, entitled "Container Assembly with One-Piece Child-Resistant Closure," the entire contents of which are incorporated herein by reference in their entirety.

BACKGROUND OF THE INVENTION

The preferred present invention relates generally to container assemblies and, more specifically, a container having a removable cap.

Container assemblies typically include a cap for containing a pharmaceutical or nutritional product within a bottle or other container. The cap may be "child-resistant," such that the cap is difficult for children, but also for seniors to remove from the container and/or the cap has passed performance tests with respect to a degree or level of difficulty in removing the cap from the container.

Child resistant closures for screw type container finishes are often referred to as "push and turn" and "squeeze and turn." The former type requires the user to push down on the closure in order to remove the closure from the container. The latter requires sides of the closure to be squeezed in order to remove the closure from the container.

Push and turn closures may include an outer cap and an inner cap. The inner cap is typically free to rotate and move vertically within the outer cap. Push and turn closures are known to cause problems in filling lines due to overall height variations of the closure. The two pieces generally engage with one another creating a single acting closure to open. Generally, the engagement between the two pieces is by gear or ratchet mechanism. Two piece enclosures are expensive to manufacture and can be difficult to open.

Squeeze and turn closures can be difficult for adults having limited dexterity and strength from arthritis and similar joint diseases to grip and open.

It would be desirable to construct and implement a push and turn child resistant closure which is constructed as one piece in order to reduce manufacturing costs. Further, it is desirable to increase the ease by which push and turn caps can be opened by adults while maintaining child resistance, because persons whom operate the caps frequently have impaired hand strength and dexterity that may render opening caps difficult.

BRIEF SUMMARY OF THE INVENTION

Briefly stated, a preferred embodiment of the present invention is directed to a container and child-resistant closure system includes a cap formed from a single piece, a cup shaped inner member having a top wall, outer wall, and a depending sidewall. The sidewall is preferably provided with a threaded interior surface. The outside wall of this closure is preferably provided with connections to an outer member. The outer member comprises a ring-shaped body and a plurality of inwardly facing lugs, wherein each one of the plurality of inwardly facing lugs protrudes from the inside wall of the outer member. The system also includes a container including a neck forming an opening of the container. The neck has a threaded exterior surface and a plurality of ramps. Each one of the plurality of ramps faces outwardly from the neck and has a gently sloping face and a steeply sloping face.

In another aspect, a preferred embodiment of the present invention is directed to a container assembly including a cap and a container. The cap includes an inner member with a top wall and a downwardly depending sidewall having an inner surface and outer surface. The inner surface has cap threads extending therefrom. The cap further includes an outer member having a ring-shape with a plurality of inwardly facing lugs. The cap also includes connection members extending between the inner member and the outer surface. The connection members are configured to permit the outer member to deflect substantially vertically relative to the inner member. The container has a neck and a body. The neck forms an opening of the container. The neck has container threads on an exterior surface. A plurality of ramps protrudes outwardly from the exterior surface. Each of the plurality of ramps has a gently sloping face and a steeply sloping face relative to a ramp plane that extends through the plurality of ramps. The plurality of ramps and the plurality of lugs are configured such that the cap is securable to the container by advancing the cap threads onto the container threads until the plurality of lugs slide along the gently sloping faces of the ramps and then upwardly along the steeply sloping faces. When the plurality of lugs slide upwardly along the steeply sloping faces, the cap is substantially locked onto the container in a locked position.

In yet another aspect, a preferred embodiment of the present invention is directed to a child-resistant container assembly for storing pharmaceutical or nutritional products. The container assembly includes a cap and a container. The cap has an inner member with a top wall and a downwardly depending sidewall having an inner surface and outer surface. The top wall defines a cap wall plane and the sidewall defining a cap diameter. The inner surface has cap threads extending therefrom. The cap further includes an outer member having a ring-shape defining an outer member diameter. The outer member has a top surface defining a top plane. First and second inwardly facing lugs extend radially inwardly from the outer member toward the sidewall. The outer member diameter is greater than the cap diameter. Connection members are fixed to the sidewall and the outer member. The outer member is positioned such that the top plane is spaced above the cap wall plane at a distance in a biased configuration. A container includes a neck and a body. The neck forms an opening of the container. The neck has container threads on an exterior surface that are configured to mate with the cap threads. First and second ramps protrude outwardly from the exterior surface. Each of the first and second ramps have a gently sloping face and a steeply sloping face relative to a ramp plane extending through the first and second ramps. The first lug is positioned proximate the steeply sloping face of the first ramp and the second lug is positioned proximate the steeply sloping face of the second ram in a locked position. A superior surface of the first lug and an inferior edge of the first ramp define an interference when the cap is in the biased configuration and the cap and container are in the locked position. The distance is equal to or greater than the interference.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
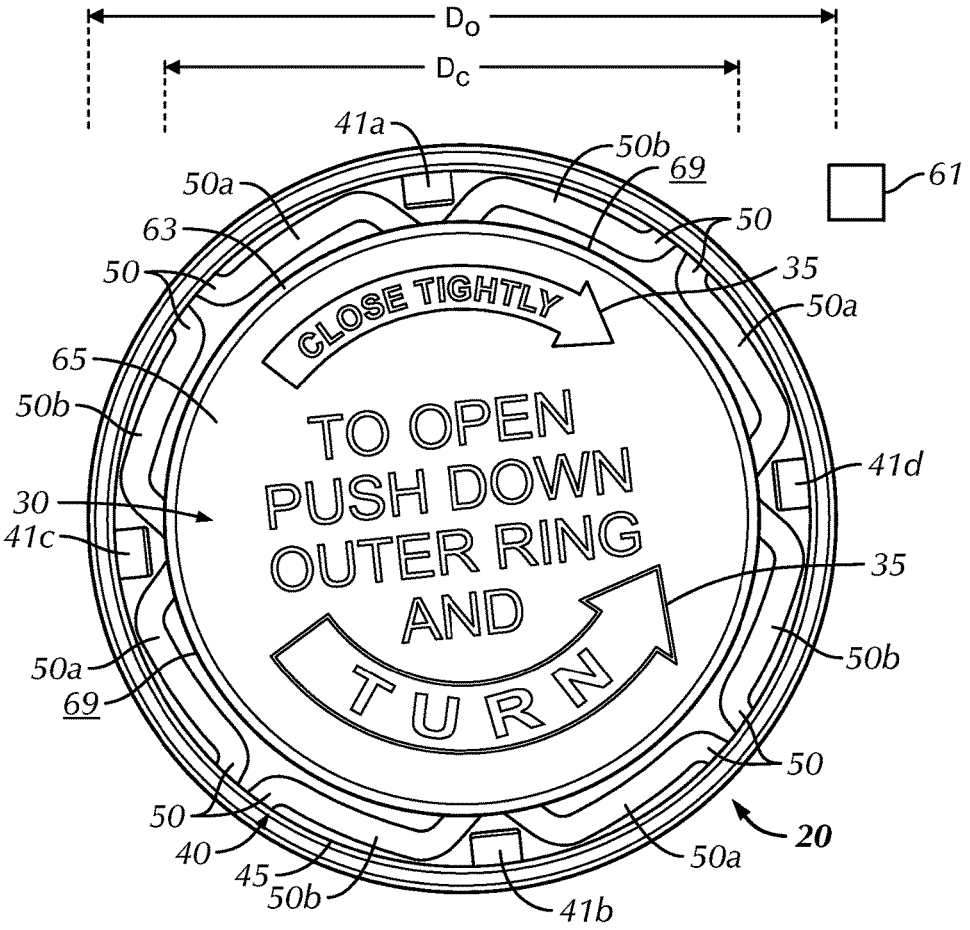
FIG. 1 is a top plan view of a cap of a container assembly in accordance with a preferred embodiment of the present invention.
Figure 1A:
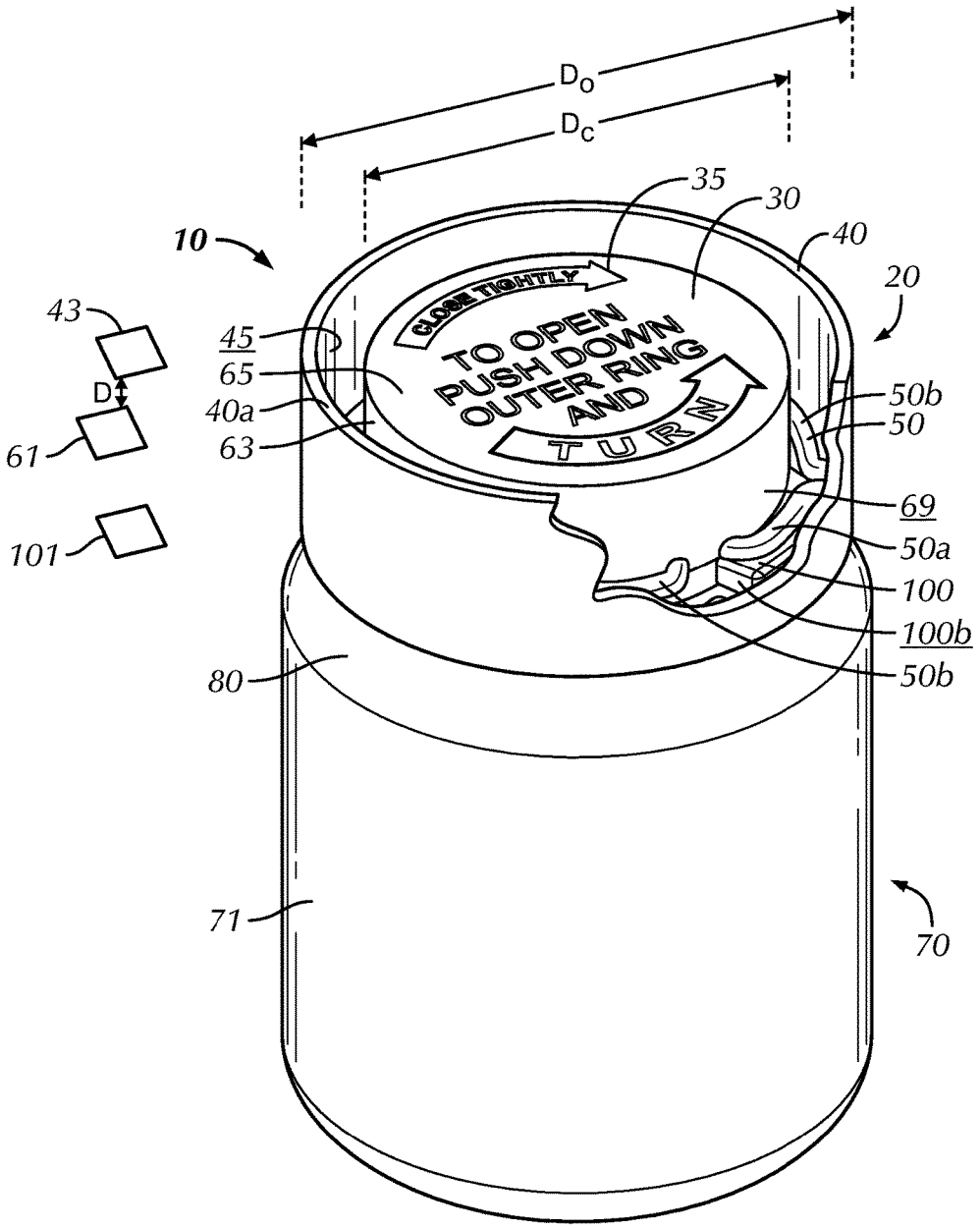
FIG. 1A is a top perspective view of the container assembly in accordance with the preferred embodiment of the present invention, including the cap of FIG. 1 with a partial cut-away of an outer member of the cap to shown preferred connection members.
Figure 2:
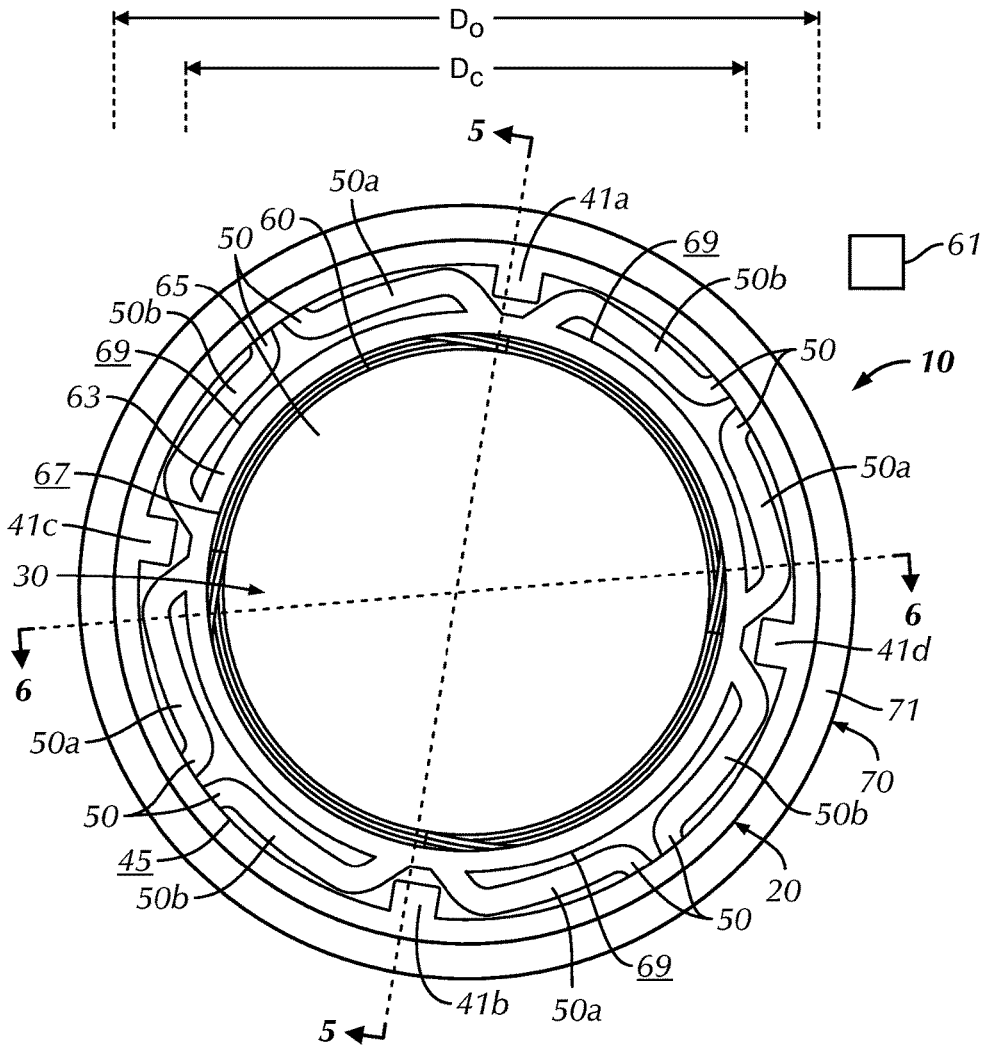
FIG. 2 is a bottom plan view of the cap and container assembly of FIG. 1A, wherein the container is shown as generally transparent except for the outer surface of a body of the container to facilitate depiction of the bottom of the cap.

Certain terminology is used in the following description for convenience only and is not limiting. Unless specifically set forth herein, the terms "a", "an" and "the" are not limited to one element but instead should be read as meaning "at least one". The words "right," "left," "lower," and "upper" designate directions in the drawings to which reference is made. The words "inwardly" or "distally," "superior" or "inferior" and "outwardly" or "proximally" refer to directions toward and away from, respectively, the geometric center or orientation of the container assembly and related parts thereof. The terminology includes the above-listed words, derivatives thereof and words of similar import.

Referring to the drawings in detail, wherein like numerals indicate like elements throughout, FIGS. 1-6 show a container assembly, generally indicated as 10, in accordance with a preferred embodiment of the present invention. The container assembly 10 may be used for storing and/or dispensing pharmaceutical or nutritional products, such as tablets, caplets or other forms of medication. The container assembly 10 is preferably a child-resistant container assembly 10. The container assembly 10 may be used for storing various types of material other than medication, such as a powder for drug reconstitution or nearly any other item that has a size and shape that is able to fit into the container assembly. The container assembly 10 preferably includes a cap 20 and a container 70.

Referring to FIGS. 1, 2 and 5A-6, the cap 20 is preferably constructed in one piece and is fabricated from a polymeric material, such as a thermoplastic material. In a preferred embodiment, the cap 20 is constructed of polypropylene material, but is not so limited and may be constructed of nearly any material, preferably a polymeric material. The cap 20 is preferably formed using injection molding or other similar manufacturing techniques, but is not so limited. The cap 20 is not limited to being constructed of the above-listed materials or techniques and may be constructed of any material and using any technique that is able to produce the general size and shape of the preferred cap 20 that functions in the manner of the preferred cap 20, as is described in greater detail below.

Figure 3:
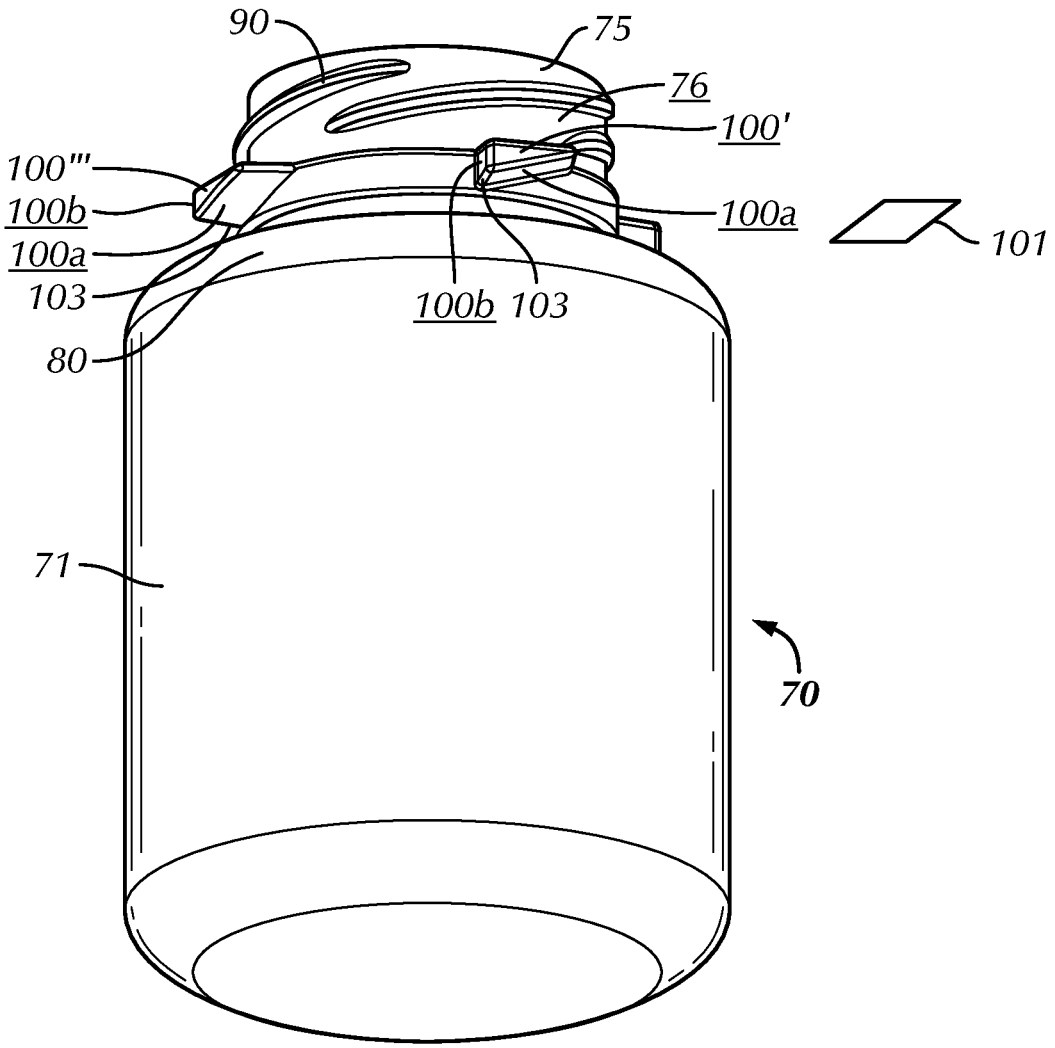
FIG. 3 is a side perspective view of a container of the container assembly of FIG. 1A.
Figure 4:
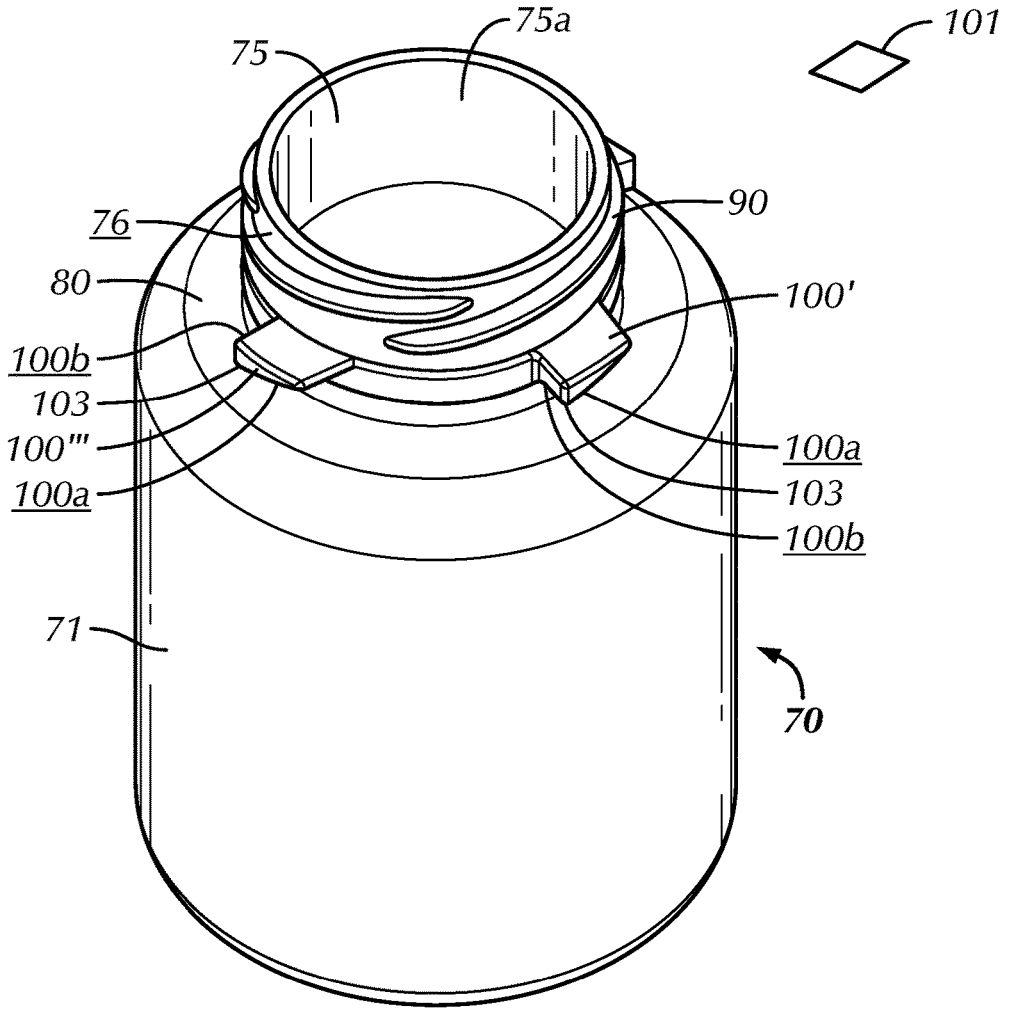
FIG. 4 is a top perspective view of the container of FIG. 3.

Referring to FIGS. 3 and 4, the container 70 of the preferred container assembly 10 is also preferably formed from a polymeric material, such as a thermoplastic material, using blow molding or other techniques. In a preferred embodiment, the container 70 is constructed of a high density polyethylene material, but is not so limited and may be constructed of numerous other materials, such as glass or other polymeric materials. The container 70 is not limited to being constructed using the above-listed materials or the described manufacturing techniques and may be constructed of any material and using any technique that is able to produce the general size and shape of the preferred container 70 that functions in the manner of the preferred container 70, as is described in greater detail below. The container 70 and cap 20 are also preferably constructed of medical grade materials to facilitate use of the container assembly 10 for pharmaceuticals, but are not so limited and may be constructed of non-medical grade materials when used in non-medical applications.

As used herein, the term "container" refers to any type of storage receptacle for holding solid, liquid or gaseous material, including but not limited to bottles, vials, tubes, vessels, or other receptacles, having at least one opening for depositing or dispensing contents. The term "cap" refers to any type of closure for closing the opening of a container, including but not limited to lids, covers and seals.

Referring to FIGS. 1-6, the cap 20 of the preferred embodiment includes an inner member 30, an outer member 40, and connection members 50 extending between an outer surface 69 of the inner member 30 and the outer member 40. The inner member 30 has a general cup-shape and includes a top wall 65 and a downwardly depending sidewall 63 with an inner surface 67 and the outer surface 69. The top wall 65 defines an inner cap top plane 61 and the sidewall 63 defines a cap diameter $D_c$. The sidewall 63 preferably includes cap threads 60 extending radially inwardly from the inner surface 67 of the sidewall 63. The cap threads 60 are preferably quarter-turn cap threads 60 that fully seat the cap 20 on the container 70 with a quarter-turn, but are not so limited and may be comprised of nearly any type and variety of thread that is able to secure the cap 20 to the container 70. However, the quarter-turn cap threads 60 are preferred to facilitate locking of the cap 20 to the container 70 with the relatively limited pivoting motion required to seat the preferred quarter-turn cap threads 60, as will be described in greater detail below. The cap 20 of the preferred embodiment also includes markings 35 that indicate the direction of turn required to unlock the cap 20 from the container 70 and the direction of turn required to engage or tighten the cap 20 to the container 70. The cap 20 is not limited to including these markings 35, but the markings 35 are preferred to provide simple indications to the user regarding opening and closing of the cap 20 relative to the container 70. The cap 20 may also include additional markings 35 in combination with or supplemental to the arrow markings, such as directions for a user indicating how the cap 20 is operated for opening and closing, e.g. "TO OPEN PUSH DOWN OUTER RING AND TURN" or "CLOSE TIGHTLY."

The connection members 50 are positioned between the inner member 30 and an outer member 40 and connect the inner member 30 to the outer member 40. The connection members 50 are fixed to and protrude from the outer surface 69 of the inner member 30 and an inner wall 45 of the outer member 40. Each connection members 50 preferably includes a first connection member 50*a* and a second connection member 50*b* which are preferably mirror images of each other. Each of the first and second connection members 50*a*, 50*b* preferably protrudes from the outer surface 69 of the inner member 30 at an angle in the direction of the other first or second connection member 50*a*, 50*b*, respectively, without extending completely to the inner wall 45 of the outer member 40. Each of the first and second connection member 50*a*, 50*b* then turns and extends directly towards the other of the first or second connection member 50*a*, 50*b*, respectively, in a direction along the circumference of the inner member 30, without extending completely to the opposing first or second connection member 50*a*, 50*b*. Each of the first and second connection members 50*a*, 50*b* then turns at an angle towards the inner wall 45 of the outer member 40 and the first and second connection members 50*a*, 50*b* connect or are fixed to the inner wall 45 of the outer member 40. In the preferred embodiment, the cap 20 includes eight (8) connection members 50, including four first connection members 50*a* and four second connection members 50*b*, that movably connect the outer member 40 to the inner member 30. The connection members 50 are not limited to the shown and described shape and configuration of FIGS. 1, 2, 5 and 6 and may be comprised of nearly any shape, for example, cylindrical, zig-zag, rectangular or parallelepiped shapes, and any material, for example, polymeric, rubber, elastic polymeric or shape-memory metallic materials, that allow for a vertical deflection of the outer member 40 relative to the inner member 30, as is described in greater detail below. Preferably, the connection members 50 are integrally molded or formed with the inner and outer members 30, 40 from a polypropylene material. The connection members 50 may alternatively be separately connected to the inner and outer members 30, 40 or otherwise secured to the inner and outer members 30, 40.

The outer member 40 is preferably ring-shaped with a circumference larger than that of the inner member 30. The outer member 40 includes a plurality of inwardly facing lugs 41 that extend generally radially inwardly from the inner wall 45. The outer member 40 defines an outer member diameter $D_O$. The plurality of lugs 41 protrude from the inner wall 45 preferably below where the connection members 50*a*, 50*b* protrude from the outer surface 69 of the inner member 30 and connect to the inner wall 45 of the outer member 40. Each of the plurality of lugs 41 is preferably cylindrically-shaped with an inwardly facing flat wall, but is not so limited and the lugs 41 may have nearly any shape that promotes engagement and locking of the cap 20 relative to the container 70 with the assistance of the lugs 41, as is described in greater detail below. In the preferred embodiment, the cap includes four (4) lugs 41 extending from the inner wall 45 generally evenly spaced along the inner wall 45. The cap 20 is not limited to having four (4) lugs 41 and may include nearly any number of lugs 41 that preferably correspond to the ramps 100 of the container 70, as will be described in greater detail below. The lugs 41 separate the connecting members 50 into four (4) pairs of first and second connection members 50*a*, 50*b* in the preferred embodiment.

The container 70 preferably has a generally cylindrical body 71 defining a cavity or containment area 72 therein. However, the container 70 may have one of any of a number cross-sectional configurations, including cylindrical, oblong, polygonal, rectangular, box-shaped or other shapes. As shown in FIGS. 3 and 4, the container 70 preferably includes a neck 75, wherein an exterior surface 76 of the neck 75 is provided with container threads 90 adapted to mate with the cap threads 60 of the inner member 30. The neck 75 preferably defines an opening 75*a* of the container 70. The container threads 90 preferably extend radially outwardly from the exterior surface 76 of the neck 75. The container threads 90 are preferably quarter-turn threads that fully seat the cap 20 on the container 70 with a quarter-turn, but are not so limited and may be comprised of nearly any type and variety of thread that is able to locking the cap 20 to the container 70. However, the quarter-turn container threads 90 are preferred to facilitate locking of the cap 20 to the container 70 with the relatively limited pivoting motion required to seat the preferred quarter-turn threads and to mate with the preferred quarter-turn cap threads 60 of the cap 20.

The container 70 also preferably includes a lip 80 disposed at the base of the neck 75. The lip 80 is an upwardly facing, relatively flat surface that may stop the outer member 40 when it is pushed down to operate the container assembly, as is described in greater detail below. However, the container 70 is not so limited and may be include nearly any type and variety of lip 80 that is able to prevent the outer member 40 from extending downwardly so far as to irreversibly deform any portion of the cap 20 when it is pushed down to operate the container assembly 10, as is described below. Further, there may not be a lip 80 at all such that the body 71 of the container 70 extends downwardly relatively flush or inwardly relative to the neck 75. The container 70 preferably includes a plurality of ramps 100, wherein each one of the plurality of ramps 100 protrudes radially outwardly from the neck 75. The ramps 100 are preferably positioned below the container threads 90 and have a gently sloping face 100*a* and a steeply sloping face 100*b*. In the preferred embodiment, the container 70 includes four (4) ramps 100 extending radially outwardly from the neck 75 to correspond and mate with the four (4) preferred lugs 41 of the cap 20. The ramps 100 are preferably positioned between the lip 80 and the container threads 90 extending radially outwardly from the neck 75.

Referring to FIGS. 3-6, the ramps 100 define a ramp plane 101 that extends through the ramps 100. The gently sloping face 100*a* is relatively gently sloping or slopes at a relatively small acute angle relative to the ramp plane 101 in the preferred embodiment. The steeply sloping face 100*b* of the preferred embodiment is relatively steeply sloping or slopes, if at all, at a substantially right angle relative to the ramp plane 101 and is oriented at a substantially right angle relative to the ramp plane 101 in the preferred embodiment. The ramps 100 are not limited to having the gently sloping faces 100*a* and the steeply sloping faces 100*b* and may be otherwise configured to interact with the lugs 41 such that the lugs 41 are able to slide past the ramps 100 in a tightening direction and are blocked or locked relative to the ramps 100 in an opening direction. In the preferred embodiment, the tightening direction is clockwise when looking downwardly onto the cap 20 (See FIG. 1) and the opening direction is counterclockwise when looking downwardly onto the cap 20.

In accordance with the preferred embodiment, the lugs 41 are located to correspond to and selectively engage with the ramps 100. The ramps 100 are preferably located annularly at evenly spaced intervals, in proximity to the outer surface 69 of the inner member 30. Accordingly, the lugs 41 should similarly be located to correspond to the ramps 100, i.e., annularly at evenly spaced intervals, in proximity to an inner wall 45 of the outer member 40. The container assembly 10 is not so limited and may be comprised of nearly any number of lugs 41 and ramps 100 that is able to lock the cap 20 to the container 70, preferably in a child-resistant manner or even a non-child-resistant fashion.

Referring to FIGS. 1-6, in operation, the cap 20 is threaded onto the neck 75 by rotation of the cap 20 relative to the container 70 in a first direction or in the tightening direction, as shown by the marking 35 or arrow labeled "CLOSE TIGHTLY" of FIG. 1. The cap 20 advances onto the container neck 75 through engagement of the cap threads 60 and the container threads 90 until the lugs 41 slide radially along the gently sloping faces 100*a* of the ramps 100 and then, relatively abruptly, upwardly along the steeply sloping faces 100*b*, thereby locking the cap 20 onto the container 70. The cap 20 is locked from opening or from rotating in the opening direction by interaction of the lugs 41 with the steeply sloping faces 100*b*, which generally prevent substantial rotation of the cap 20 in the opposite opening direction relative to the container 70. In this locked position, the cap 20 is in a biased configuration (FIGS. 5A and 6), wherein the connections 50 are substantially relaxed such that they are not urging the outer member 40 to move in any direction relative to the inner member 30. In the biased configuration, a top wall or top edge 40*a* of the outer member 40 is preferably vertically spaced from a top wall 65 of the inner member 30 by a distance D. In the preferred embodiment, the inner cap top plane 61 is also spaced by the distance D from an outer cap top plane 43 defined by the top wall or top edge 40*a* of the outer member 40. The cap 20 can continue turning in the first tightening direction, because as the lugs 41 reach each of the sequential ramps 100, the lugs 41 slide radially along the gently sloping faces 100*a* of the ramps 100 and then upwardly along the steeply sloping faces 100*b*. Alternatively, the gently sloping ramp faces 100*a* may be positioned on the top of the ramps 100 such that the lugs 41 slide over the top of the ramps 100 and drop downwardly along the steeply sloping faces 100*b* when the cap 20 is rotated onto the container 70. In addition, the steeply sloping faces 100*b* are not limited to generally planar faces and may be comprised of convex or concave faces that generally block movement of the lugs 41 relative to the ramps 100 when the cap 20 is in the locked position relative to the container 70. For example, the steeply sloping faces 100*b* may be comprised of a cavity (not shown) that accepts the lugs 41 therein in the locked position to substantially limit movement of the outer member 40 relative to the inner member 30 until the cap 20 is rotated in the tightening direction to move the lugs 41 out of the cavities such that the outer member 40 may be vertically displaced relative to the inner member 30.

In the preferred embodiment, a user may press down on the outer member 40 when it is in the biased configuration, thereby deflecting the lugs 41 out of engagement with the ramps 100 or downwardly along the steeply sloping surfaces 100*b* allowing the cap 20 to be rotated in the second or opening direction, indicated by the marking 35 arrow labeled "TURN" in FIG. 1, and removed from the container 70. When the user presses down on the outer member 40, preferably on the top wall 40*a* of the outer member 40, the outer member 40 preferably moves to a position substantially flush or on substantially the same plane as the top wall 65 of the inner member 30, thereby disengaging the lugs 41 from the ramps 100 or moving the lugs 41 out of the plane of the ramps 100. The top wall or top edge 40*a* of the outer member 40 preferably defines an outer cap top plane 43 that is positioned above or spaced above the inner cap top plane 61 in the biased configuration. When the user pressed down on the outer member 40, the outer cap top plane 43 preferably moves downwardly such that it is substantially co-planar or positioned substantially planar and in proximity to the inner cap top plane 61 in the depressed configuration (See FIG. 5B).

In the preferred depressed configuration, the user continues to apply the downward force onto the outer member 40 to substantially maintain the top wall of the outer member 40 on or in close proximity to the inner cap top plane 61. In the depressed configuration, the top wall 40*a* of the outer member 40 is not necessarily aligned on the inner cap top plane 61 and the top wall 40*a* of the outer member 40 may be positioned above, below or angled relative to the top wall 65 of the inner member 30 or the inner cap top plane 61, as long as the lugs 41 are moved to a position such that the lugs 41 move past the ramps 100 when the cap 20 is rotated relative to the container 70. The top wall 40*a* of the outer member 40 is preferably substantially on the same plane as the top wall 65 of the inner member 30 in the depressed configuration or with the outer cap top plane 43 substantially co-planar with the inner cap top plane 43 in the preferred embodiment. Positioning the outer cap top plane 43 substantially co-planar with the inner cap top plane 61 in the depressed configuration is relatively simple for the user to accomplish by pushing down with their hand or palm of their hand onto the top wall 40*a* of the outer member 40 until their hand or palm impacts the top wall 65 of the inner member 30.

In the preferred embodiment, the lugs 41 include first, second, third and fourth lugs 41*a*, 41*b*, 41*c*, 41*d* extending radially inwardly from the outer member 40. The lugs 41 are referred to generically with the reference number "41" and individually with the reference numbers "41*a*," "41*b*," "41*c*," "41*d*," respectively. The cap 20 is not limited to including four (4) lugs 41 and may include nearly any number of lugs 41 that permits locking of the cap 20 relative to the container 70, as is described herein. The first and second lugs 41*a*, 41*b* preferably extend radially inwardly from the outer member 40 toward the sidewall 63 and are preferably spaced below the sidewall 63 in the biased and depressed configurations. An outer member diameter $D_O$ of the outer member 40 is greater than a cap diameter $D_C$ of the inner member 30 measured substantially at the sidewall 63. The connection members 50 as substantially positioned in a spaced between the outer member 40 and the inner member 30 such that the outer member diameter $D_O$ is greater than the cap diameter $D_C$.

Figure 5A:
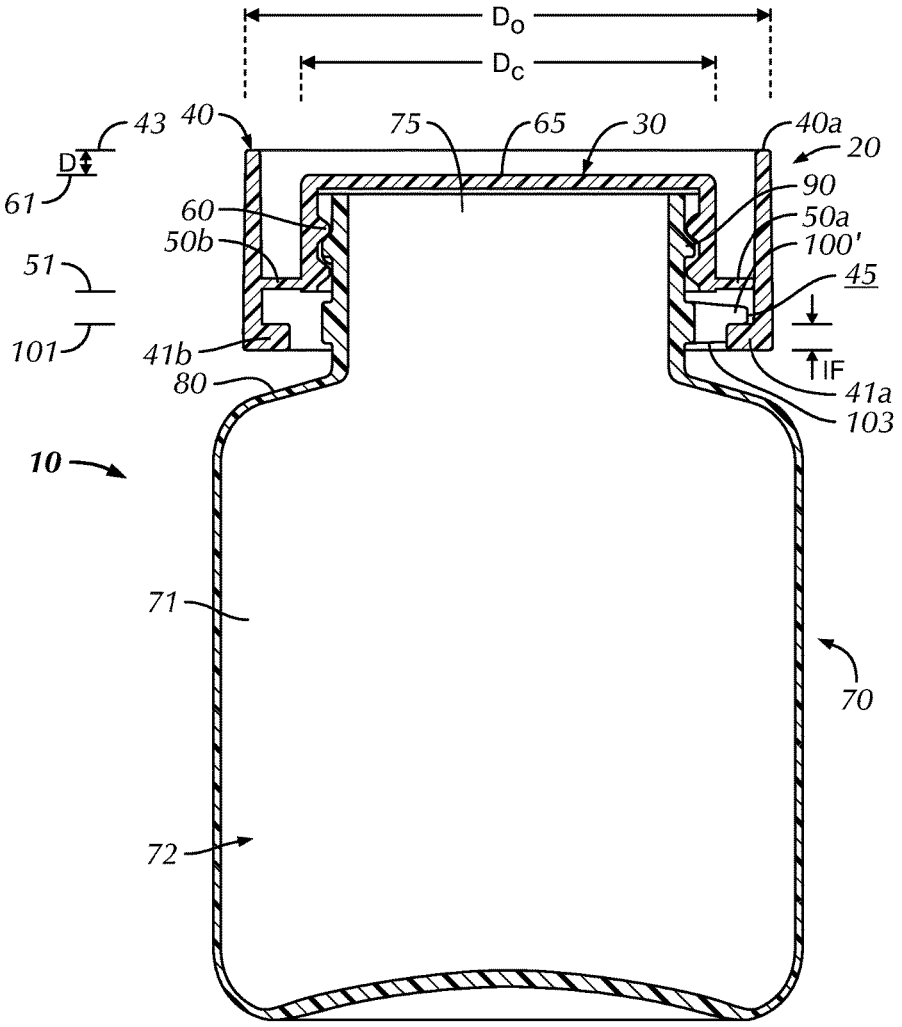
FIG. 5A is a cross-sectional view of the cap and container assembly of FIG. 1A, taken along line 5-5 of FIG. 2 with the cap positioned in a biased configuration.
Figure 5B:
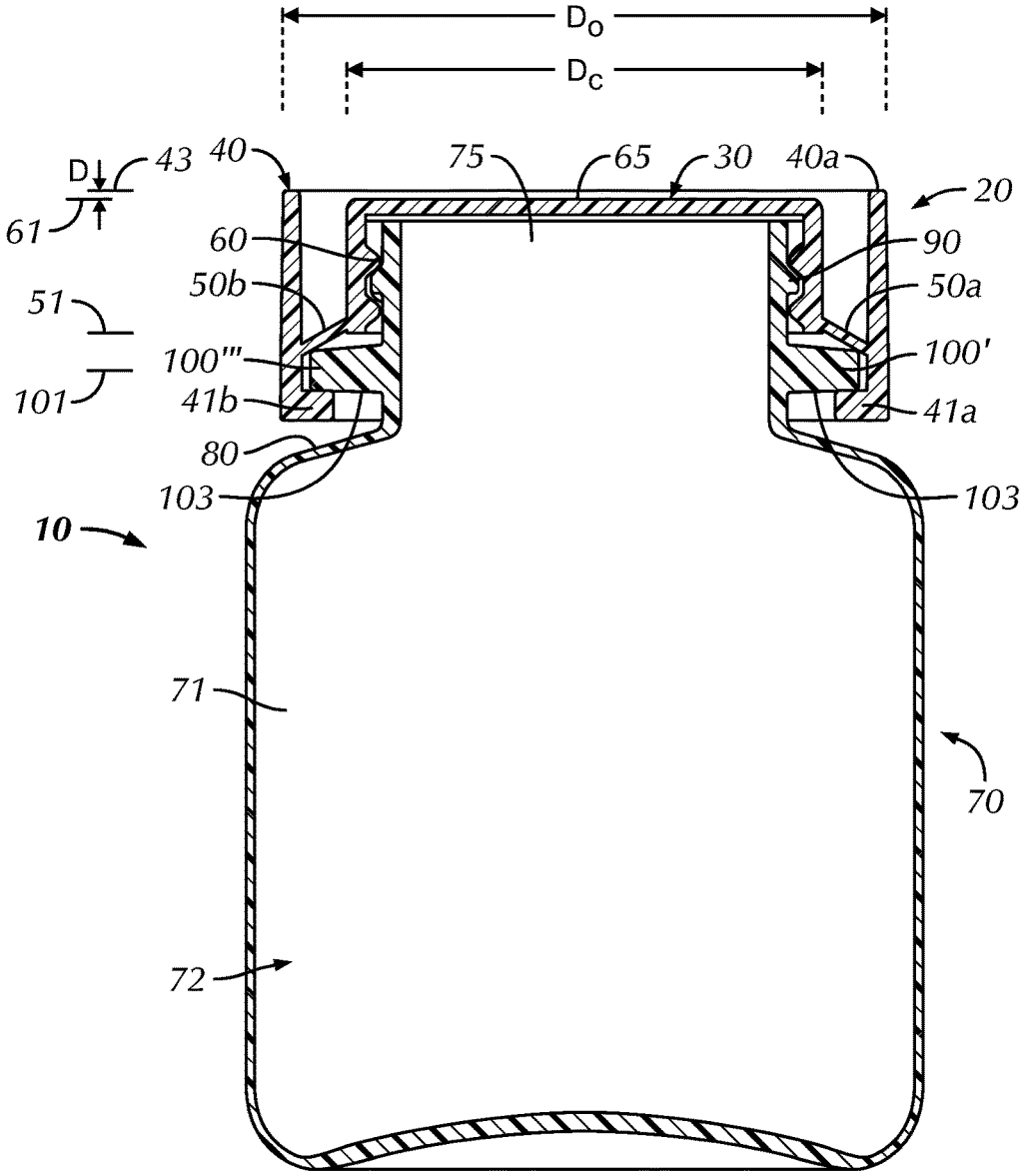
FIG. 5B is a cross-sectional view of the cap and container assembly of FIG. 1A, taken along line 5-5 of FIG. 2 with the cap positioned in a depressed configuration and an outer member of the cap rotated relative to the container.
Figure 6:
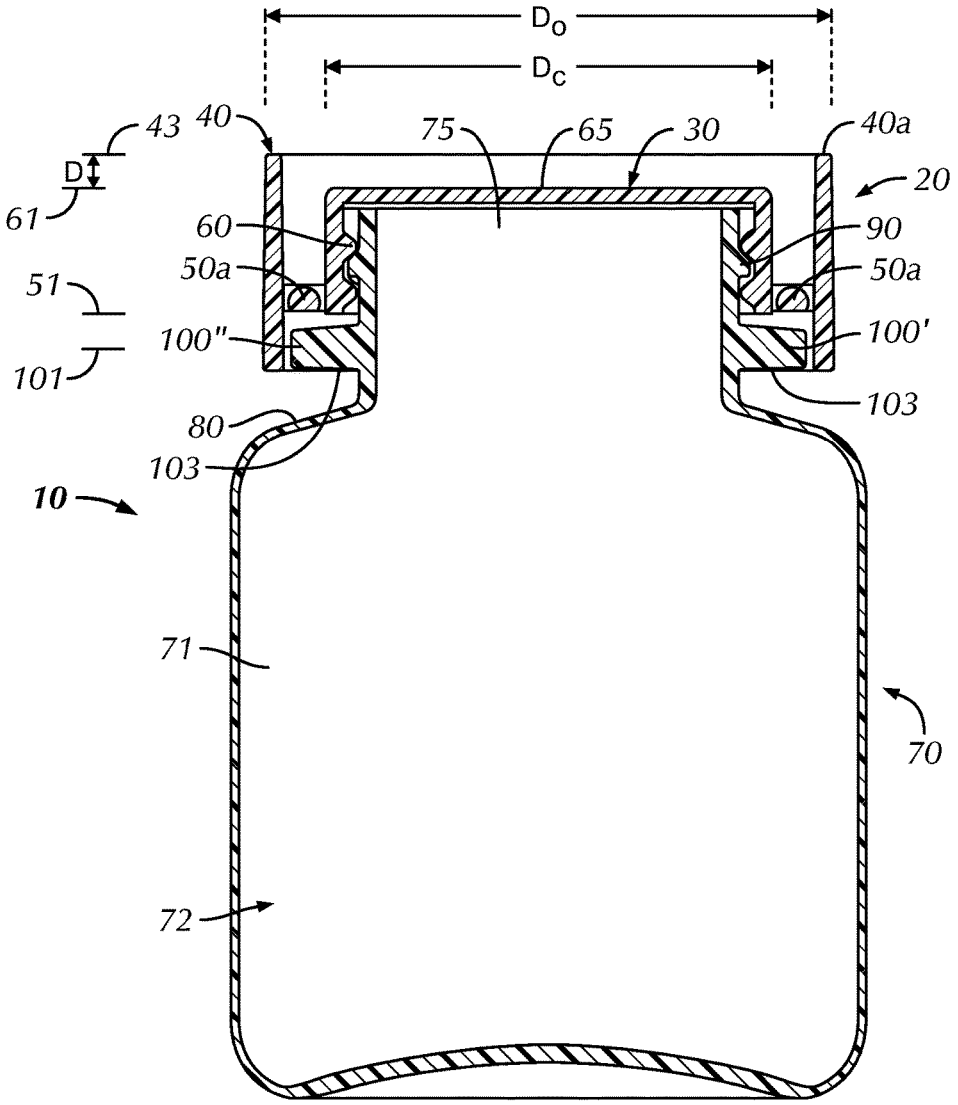
FIG. 6 is cross-sectional view of the cap and container assembly of FIG. 1A, taken along line 6-6 of FIG. 2 with the cap in the biased configuration and the cap and the container located in a locked position.

The ramps 100 preferably include first, second, third and fourth ramps 100', 100', 100''' extending radially outwardly from the neck 75 of the container 70. The ramps 100 are referred to generically with the reference number "100" and individually with the reference numbers "100'," "100"," "100'''," respectively, with the fourth ramp not shown. The container 70 is not limited to including four (4) ramps 100 and may include nearly any number of ramps 100 that permits locking of the cap 20 relative to the container 70, as is described herein. The first and second ramps 100', 100" preferably extend radially outwardly from opposite sides of the neck 75 and interact with the first and second lugs 41*a*, 41*b*. Each of the ramps 100 have the gently sloping face 100*a* and the steeply sloping face 100*b* that slope relative to the ramp plane 101. The first lug 41*a* is positioned proximate the steeply sloping face 100*b* of the first ramp 100' and the second lug 41*b* is positioned proximate the steeply sloping face 100*b* of the second ramp 100" in the locked position, such that the interaction between the first and second lugs 41*a*, 41*b* and the steeply sloping faces 100*b* of the first and second ramps 100', 100" substantially block rotation of the cap 20 relative to the container 70 in the opening direction when the cap 20 is in the biased configuration. In the preferred embodiment, the first lug 41*a* interacts with the first ramp 100', the second lug 41*b* interacts with the second ramp 100", the third lug 41*c* interacts with the third ramp 100'" and the fourth lug 41*d* interacts with the fourth ramp. The lugs 41 and ramps 100 are not limited to interacting with specific counterparts and are preferably universally constructed such that any of the lugs 41 may interact with any of the ramps 100 in operation of the container assembly 10. Referring to FIG. 5A, in the locked position, a superior surface 45 of the first lug 41*a* and an inferior edge 103 of the first ramp 100' define an interference IF when the cap 20 is in the biased configuration and the cap 20 and container 70 are in the locked position. Each of the second, third and fourth lugs 41*b*, 41*c*, 41*d* and second, third and fourth ramps 100", 100'" also preferably define the same interference IF that together inhibit or block movement of the cap 20 relative to the container 70 in the locked position. The distance D between the outer cap top plane 43 and the inner cap top plane 61 is preferably greater than the interference IF, such that moving the cap 20 to the depressed configuration from the biased configuration results in the tops of the lugs 41*a*, 41*b*, 41*c*, 41*d* being positioned below the inferior edges 103 of the first, second, third and fourth ramps 100', 100", 100'".

The container assembly 10 preferably provides the deflectable outer member 40 with the inwardly extending lugs 41 that are selectively engageable with the ramps 100. The thermoplastic material from which the cap 20, including the connections 50, is preferably formed allows vertical deflection of the outer member 40 relative to the top wall 65 of the inner member 30. In the preferred embodiment, the cap 20 is integrally molded of a polypropylene material. Disengagement of the lugs 41 is accomplished by applying a force sufficient to deflect the outer member 40 relative to the inner member 30 from the biased configuration to the depressed configuration. In the biased configuration, the lugs 41 are positioned such that there is the interference IF between each of the lugs 41*a*, 41*b*, 41*c*, 41*d* and each of the ramps 100', 100", 100'", respectively. In the depressed configuration, the lugs 41 are preferably positioned such that the tops of each of the lugs 41*a*, 41*b*, 41*c*, 41*d* are positioned below and clear the inferior edges of the ramps 100', 100", 100'". When the lugs 41 move out of engagement with the steeply sloping faces 100*b* of the ramps 100 in the depressed configuration, the cap 20 is rotatable in the loosening or opening direction to thereby remove the cap 20 from the container 70 by preferably pivoting the cap 20 a quarter-turn relative to the container 70. Furthermore, the container assembly 10 is preferably formed from an injection mold, which enhances the ease of manufacturing of the cap 20 and container 70 thus lowering the cost of the preferred assembly 10. The container assembly 10 is not so limited and the container 70 and cap 20 may be otherwise constructed using alternative materials, such as by blow molding the container 70. In the preferred embodiment, the container 70 is constructed of a high density polyethylene material, but is not so limited and may be constructed of nearly any material that is able to be formed into the general size and shape of the container 70 and withstand the normal operating conditions of the container 70. The cap 20 and container 70 may be constructed of the same or a similar material, but are not so limited.

In the preferred embodiment, the outer member 40 can be deflected from the biased configuration to the depressed configuration relative to the inner member 30 with limited downward force applied to the top wall or top edge 40*a* of the outer member 40. In addition, while the downward force is applied to the top wall 40*a*, the user is also preferably able to rotate the cap 20 relative to the container 70 with a moderate torque applied to the cap 20 relative to the container 40 to open the container assembly 10. Simultaneously applying the downward force on the top wall 40*a* and the moderate torque on the cap 20 relative to the container 70 facilitates opening the container assembly 10 by users having limited dexterity with their hands, while maintaining the preferred child-resistant configuration of the container assembly 10. Specifically, opening of the preferred container assembly 10 preferably requires two motions or actions by the user including: (1) applying the downward force to the top wall or top edge 40*a* to move the outer member 40 from the biased configuration to the depressed configuration and (2) applying the moderate torque to the cap 20 relative to the container 40 to move the cap 20 at least the quarter-turn relative to the container 70 such that the cap 20 may be removed from the container 70. Applying the downward force to the top wall 40*a* moves the lugs 41*a*, 41*b*, 41*c*, 41*d* downwardly relative to the ramps 100', 100', 100'" to eliminate the interference IF, while applying the moderate torque to the cap 20 relative to the container 70 permits moving of the lugs 41*a*, 41*b*, 41*c*, 41*d* beyond the inferior edges 103 of the ramps 100', 100', 100'", guided by the interaction between the cap threads 60 and the container threads 90, to release the cap 20 from the container 70. This two (2) motion push and rotation process to remove the cap 20 from the container 70 is preferably accomplished by user's having limited dexterity and strength in their hands, while being difficult for children to accomplish.

In the preferred embodiment, the connection members 50 are positioned on a connection member plane 51 in the biased configuration. The connection members 50 preferably extend along the connection member plane 51 in the biased configuration and bias the outer member 40 to the biased configuration relative to the inner member 30. In contrast, in the depressed configuration, the connection members 50 are preferably not positioned on the connection member plane 51, but are positioned at an angle or are substantially arcuate relative to the connection member plane 51 with at least a portion of the connection members 50 being positioned on or passing through the connection member plane 51. In the depressed configuration, the connection members 50 are preferably constantly applying a biasing force to the outer member 50 and the inner member 30 urging the cap 20 from the depressed configuration to the biased configuration.

Although the present invention is illustrated and described above with references to certain specific embodiments, the present invention is not intended to be limited to the details shown. Various modifications may be made in the details within the scope and range of equivalents of the claims and without departing from the invention. For example, the lugs 41 could extent radially outwardly from the neck 75 and the ramps 100 could extend radially inwardly from the outer member 40.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the present disclosure.

We claim:

1. A container assembly comprising:

a cap including an inner member with a top wall and a downwardly depending sidewall having an inner surface and outer surface, the inner surface having cap threads extending therefrom, the cap further including an outer member having a ring-shape with a plurality of inwardly facing lugs, the cap further including connection members extending between the outer member and the outer surface, the connection members configured to permit the outer member to deflect substantially vertically relative to the inner member, the connection members include a plurality of first connection members and a plurality of second connection members, a first connection member of the plurality of first connection members being a mirror image of a second connection member of the plurality of second connection members, the first connection member protruding from the outer wall of the inner member at an angle toward the second connection member without extending completely to the inner wall of the outer member, turning and extending towards the second connection member in a direction along a circumference of the inner member and turning at an angle towards the inner wall of the outer member to connect to the inner wall; and a container including a neck and a body, the neck forming an opening of the container, the neck having container threads on an exterior surface, a plurality of ramps protruding outwardly from the exterior surface, each of the plurality of ramps having a gently sloping face and a steeply sloping face relative to a ramp plane extending through the plurality of ramps, the plurality of ramps and the plurality of lugs configured such that the cap is securable to the container by advancing the cap threads onto the container threads until the plurality of lugs slide along the gently sloping faces of the ramps and then upwardly along the steeply sloping faces, thereby locking the cap onto the container in a locked position.

2. The container assembly of claim 1, wherein the cap and container are constructed of a polymeric material.

3. The container assembly of claim 2, wherein the cap is constructed of a polypropylene material and the container is constructed of a high density polyethylene material.

4. The container assembly of claim 1, wherein the cap, including the inner member, the outer member and the connection members, is formed in one piece.

5. The container assembly of claim 1, wherein the plurality of inwardly facing lugs are substantially cylindrically-shaped, each of the plurality of lugs including an inwardly facing flat wall, the plurality of lugs being located annularly at evenly spaced intervals on an inner wall of the outer member.

6. The container assembly of claim 1, wherein the outer member can be deflected relative to the inner member with limited downward force applied to the outer member.

7. The container assembly of claim 1, wherein the container includes a lip disposed at the base of the neck, the lip being substantially flat proximate the neck.

8. The container assembly of claim 1, wherein the each of the plurality of ramps is positioned annularly at evenly spaced intervals in proximity to the neck.

9. The container assembly of claim 1, wherein the container and the cap are constructed of the same material.

10. A child-resistant container assembly for storing pharmaceutical or nutritional products, the container assembly comprising:

a cap including an inner member with a top wall and a downwardly depending sidewall having an inner surface and outer surface, the top wall defining an inner cap top plane and the sidewall defining a cap diameter, the inner surface having cap threads extending therefrom, the cap further including an outer member having a ring-shape defining an outer member diameter, the outer member having a top surface defining an outer cap top plane, first and second inwardly facing lugs extending radially inwardly from the outer member toward the sidewall, the outer member diameter being greater than the cap diameter, connection members fixed to the sidewall and the outer member, the outer member being positioned such that the outer cap top plane is spaced above the inner cap top plane at a distance in a biased configuration, the connection members include a plurality of first connection members and a plurality of second connection members, a first connection member of the plurality of first connection members being a mirror image of a second connection member of the plurality of second connection members, the first connection member protruding from the outer surface at an angle toward the second connection member without extending completely to an inner wall of the outer member, turning and extending towards the second connection member in a direction along a circumference of the inner member and turning at an angle towards the inner wall of the outer member to connect to the inner wall; and a container including a neck and a body, the neck forming an opening of the container, the neck having container threads on an exterior surface that are configured to mate with the cap threads, first and second ramps protruding outwardly from the exterior surface, each of the first and second ramps having a gently sloping face and a steeply sloping face relative to a ramp plane extending through the first and second ramps, the first lug positioned proximate the steeply sloping face of the first ramp and the second lug positioned proximate the steeply sloping face of the second ramp in a locked position, a superior surface of the first lug and an inferior edge of the first ramp defining an interference when the cap is in the biased configuration and the cap and container are in the locked position, the distance being one of equal to and greater than the interference.

11. The container assembly of claim 10, wherein the outer member is displaceable relative to the inner member by applying a force to the outer member to move the cap from the biased configuration to a depressed configuration.

12. The container assembly of claim 10, wherein the distance is greater than the interference.

13. The container assembly of claim 10, further comprising:

third and fourth lugs extending radially inwardly from the outer member toward the sidewall; and third and fourth ramps extending radially outwardly from the neck, the third lug configured to interact with the third ramp and the fourth lug configured to interact with the fourth ramp.

14. The container assembly of claim 10, wherein the connection members include four pairs of first and second connection members.

15. The container assembly of claim 10, wherein the connection members are substantially positioned on a connection member plane in the biased configuration.

16. The container assembly of claim 10, wherein the connection members are oriented substantially at an angle relative to a connection member plane in a depressed configuration.

17. The container assembly of claim 10, wherein the inner cap top plane and the outer cap top plane are substantially coplanar in a depressed configuration.

18. The container assembly of claim 10, wherein connecting members are located closer to the inner cap top plane and the outer cap top plane than the first and second lugs.

19. The container assembly of claim 10, wherein the container includes a lip between the neck and the body, the first and second ramps positioned between the lip and the container threads.

* * * * *